US007911155B2

(12) United States Patent
Kang et al.

(10) Patent No.: US 7,911,155 B2
(45) Date of Patent: Mar. 22, 2011

(54) BACKLIGHT UNIT, DISPLAY APPARATUS COMPRISING THE SAME AND CONTROL METHOD THEREOF

(75) Inventors: Jeong-il Kang, Yongin-si (KR); Sang-hoon Lee, Suwon-si (KR); Kyoung-geun Lee, Suwon-si (KR); Su-gun Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 523 days.

(21) Appl. No.: 12/100,733

(22) Filed: Apr. 10, 2008

(65) Prior Publication Data

US 2009/0045759 A1 Feb. 19, 2009

(30) Foreign Application Priority Data

Aug. 17, 2007 (KR) ..... 10-2007-0082942

(51) Int. Cl.
*H05B 37/00* (2006.01)

(52) U.S. Cl. ..... 315/291; 315/307; 345/102

(58) Field of Classification Search ..... 315/307, 315/308, 291, 209 R; 345/102, 76, 77, 82, 345/204

See application file for complete search history.

(56) References Cited

U.S. PATENT DOCUMENTS 7,375,474 B2 * 5/2008 Lee ..... 315/308
7,675,245 B2 * 3/2010 Szczeszynski et al. ..... 315/291
7,800,876 B2 * 9/2010 Peker et al. ..... 361/86

* cited by examiner

*Primary Examiner* — David Hung Vu
(74) *Attorney, Agent, or Firm* — Sughrue Mion, PLLC

(57) ABSTRACT

Provided is a display apparatus including: a display panel; a light source which includes a plurality of light source modules and supplies light to the display panel; a light source driver which drives the light source modules; a power source which supplies power to the light source driver; a current detector which detects a current of the power supplied from the power source to the light source driver; and a controller which controls the light source driver to sequentially drive the plurality of light source modules and compares the detected current with a range to detect errors from the respective light source modules.

21 Claims, 6 Drawing Sheets

BACKLIGHT UNIT, DISPLAY APPARATUS COMPRISING THE SAME AND CONTROL METHOD THEREOF

CROSS-REFERENCE TO RELATED APPLICATION

This application claims priority from Korean Patent Application No. 10-2007-0082942, filed on Aug. 17, 2007, in the Korean Intellectual Property Office, the disclosure of which is incorporated herein by reference.

BACKGROUND OF THE INVENTION

1. Field of the Invention

Apparatuses and methods consistent with the present invention relate to a backlight unit, a display apparatus comprising the same and a control method thereof, and more particularly, to a backlight unit which has a plurality light source modules driven independently, a display apparatus comprising the same and a control method thereof.

2. Description of the Related Art

In recent years, a flat panel display apparatus such as a liquid crystal display (LCD), a plasma display panel (PDP) and an organic light emitting diode (OLED) has replaced a related art cathode ray tube (CRT).

A liquid crystal panel of the LCD device does not emit light itself. Thus, a backlight unit is disposed behind the liquid crystal panel to emit light. Transmittance of light emitted by the backlight unit is adjusted by an arrangement of liquid crystals. The liquid crystal panel and the backlight unit are accommodated in a chassis. A light source of the backlight unit includes a linear light source such as a lamp or a point light source such as a light emitting diode (LED). The LED has drawn attention recently.

As the display device becomes large in size, the number of the point light sources and drivers driving the point light sources of the backlight unit has increased. As a technology such as local dimming has been developed to individually control the point light sources, the point light sources are generally driven in a unit of a plurality of light source modules.

In this case, an error detector should also be provided in every light source modules to detect the opening or short-circuit of the point light sources. Then, a configuration of the backlight unit becomes very complicated and production costs rise.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

Accordingly, it is an aspect of the present invention to provide a backlight unit which detects errors of a light source without difficulty, a display apparatus comprising the same and a control method thereof.

Also, it is another aspect of the present invention to provide a backlight unit which informs errors of a light source to a user without difficulty, a display apparatus comprising the same and a control method thereof.

Further, it is another aspect of the present invention to provide a backlight unit which has a simple configuration and reduces production costs, a display apparatus comprising the same and a control method thereof.

Additional aspects of the present invention will be set forth in part in the description which follows and, in part, will be obvious from the description, or may be learned by practice of the present invention.

The foregoing and/or other aspects of the present invention are also achieved by providing a display apparatus, including: a display panel; a light source which includes a plurality of light source modules and supplies light to the display panel; a light source driver which drives the light source modules; a power source which supplies power to the light source driver; a current detector which detects a current of power supplied from the power source to the light source driver; and a controller which controls the light source driver to sequentially drive the plurality of light source modules and compares the sequentially-detected current with a preset acceptable range to detect errors from the respective light source modules.

The controller may include a comparator which compares a voltage corresponding to the current with a predetermined reference voltage.

The reference voltage may be set to be approximately 40% to 60% of a voltage corresponding to a normal current supplied from the power source to the light source driver if the errors do not occur in the light source modules, and the controller may determine that the errors occur in the light source modules if the voltage corresponding to the current is lower than the reference voltage.

The current detector may include a resistor which is connected between the power source and the light source driver.

The display apparatus may further include a switch which is provided between the power source and the light source driver and bypasses the resistor, wherein the controller turns off the switch so that power output from the power source is supplied to the light source driver through the resistor while detecting the errors.

The switch may include a first type transistor which is connected with the resistor in parallel, and a second type transistor which has an input terminal connected with a control terminal of the first type transistor and is differently structured from the first type transistor.

The current detector may include a hall sensor.

The display apparatus may further include an interface which transmits information on error occurrence or information on the light source modules having the errors if errors occur in the light source modules.

The display apparatus may further include an error informer which displays error occurrence if the errors occur in the light source modules.

The controller may cut off power supplied from the power source to the light source driver if the errors occur in the light source modules.

The light source may module include a plurality of point light sources.

The light source driver may include a plurality of driving modules which individually drives the light source modules.

The foregoing and/or other aspects of the present invention are also achieved by providing a backlight unit, including: a light source which includes a plurality of light source modules; a light source driver which includes a plurality of driving modules to drive the light source modules; a power source which supplies power to the light source driver; an error detector which detects a current of power supplied from the power source to the light source driver, and compares the sequentially-detected current with a preset acceptable range to detect errors from the respective light source modules; and a controller which controls the light source driver to sequentially drive the plurality of light source modules, and cuts off power supplied from the power source to the light source driver if errors are detected from the light source modules.

The error detector may include a current detector which detects a current of power supplied from the power source to the light source driver, and a comparator which compares a voltage corresponding to the current with a predetermined reference voltage.

The current detector may include a resistor which is connected between the power source and the light source driver.

The error detector may further include a switch which is provided between the power source and the light source driver and bypasses the resistor, and the controller may turn off the switch so that power output from the power source is supplied to the light source driver through the resistor if the error detector detects whether the errors occur in the light source modules.

The current detector may include a hall sensor.

The backlight unit may further include an error informer which displays error occurrence if the errors occur in the light source modules.

The foregoing and/or other aspects of the present invention are also achieved by providing a control method of a display apparatus which has a display panel, a light source having a plurality of light source modules, a light source driver driving the light source modules and a power source supplying power to the light source driver, the control method including: sequentially driving the plurality of light source modules; sequentially detecting a current of power supplied from the power source to the light source driver; and detecting errors from the respective light source modules by comparing the detected current with a preset acceptable range.

The control method may further include cutting off power supplied from the power source to the light source driver if the errors occur in the light source modules.

The control method may further include informing error occurrence if the errors occur in the light source modules.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION OF EXEMPLARY EMBODIMENTS OF THE INVENTION

Hereinafter, exemplary embodiments of the present invention will be described with reference to accompanying drawings, wherein like numerals refer to like elements and repetitive descriptions will be avoided as necessary.

Figure 1:
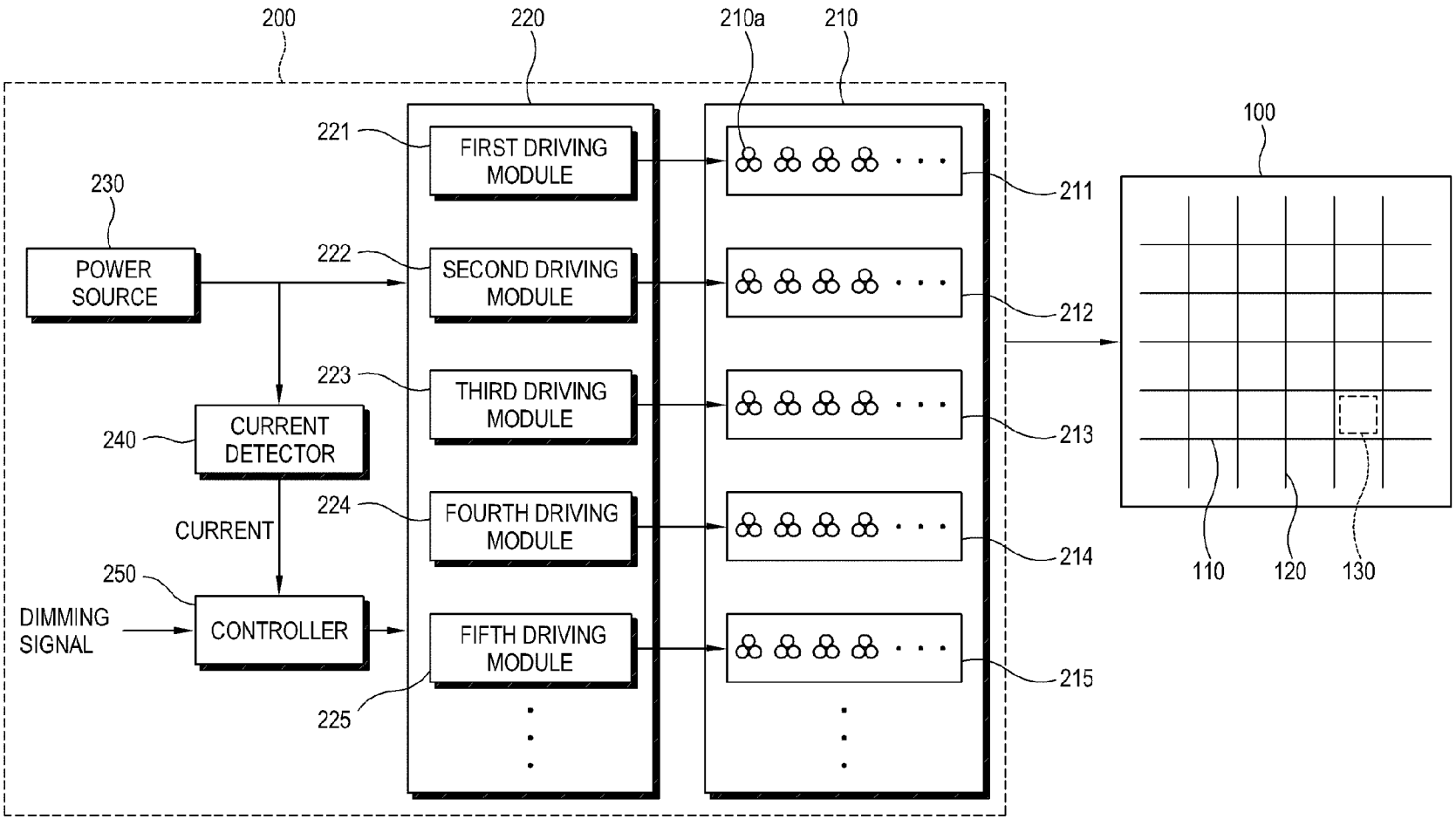
FIG. 1 is a control block diagram of a display apparatus according to a first exemplary embodiment of the present invention.

FIG. 1 is a control block diagram of a display apparatus according to a first exemplary embodiment of the present invention.

As shown therein, the display apparatus according to the present embodiment includes a display panel 100 and a backlight unit 200 which emits light behind or beside the display panel 100. The display panel 100 includes a liquid crystal panel having a liquid crystal layer (not shown), but not limited thereto. Alternatively, the display panel 100 may include other display panels as long as it receives light from the backlight unit 200. The backlight unit 200 includes a light source 210, a light source driver 220 to drive the light source 210, a power source 230 to supply power to the light source driver 220, a current detector 240 and a controller 250 to control the foregoing elements.

The liquid crystal display panel 100 includes a first substrate (not shown) which has thin film transistors, a second substrate (not shown) which faces the first substrate and a liquid crystal layer (not shown) which is formed between the first and second substrates. A gate line 110, a data line 120 and a plurality of pixels 130 are formed in the display panel 100. The plurality of pixels 130 is defined by the gate line 110 and the data line 120 which are perpendicular to each other, has a thin film transistor (not shown) and is formed in a matrix pattern.

The light source 210 includes light source modules 211 to 215 which include point light sources 210*a* and are divided into a plurality of domains. The light source 210 supplies light to the display panel 100. The point light sources 210*a* according to the present embodiment include a light emitting diode (LED), and are uniformly formed across an LED circuit substrate (not shown) disposed behind the display panel 100. The light source modules 211 to 215 include a plurality of point light source groups which has three or four LEDs. The point light source group which has three LEDs includes red, green and blue LEDs. The point light source group which has four LEDs may further include a white LED. The point light sources 210*a* which emit the same color are connected in series to form a point light source string. The point light sources 210*a* are not limited to the LED, and may include a laser diode or an oxygen nano tube. According to another exemplary embodiment, the light source 210 may include a surface light source. That is, the surface light source is plurally divided to be uniformly arranged behind the display panel 100.

The light source driver 220 includes a circuit to output driving power to the light source 210. The light source driver 220 includes a plurality of driving modules 221 to 225 corresponding to the number of the light source modules 211 to 215. A single driving module is controlled to drive a single light source module. The driving modules 221 to 225 control driving power supplied to the light source modules 211 to 215 individually, and change the driving sequence of the light source modules 211 to 215 according to a control of the controller 250.

According to another exemplary embodiment, the light source driver 220 may include a smaller number of driving modules than that of the light source modules 211 to 215. In this case, a single driving module drives more than two light source modules. The light source modules 211 to 215 are sequentially driven at predetermined time intervals.

Figure 2:
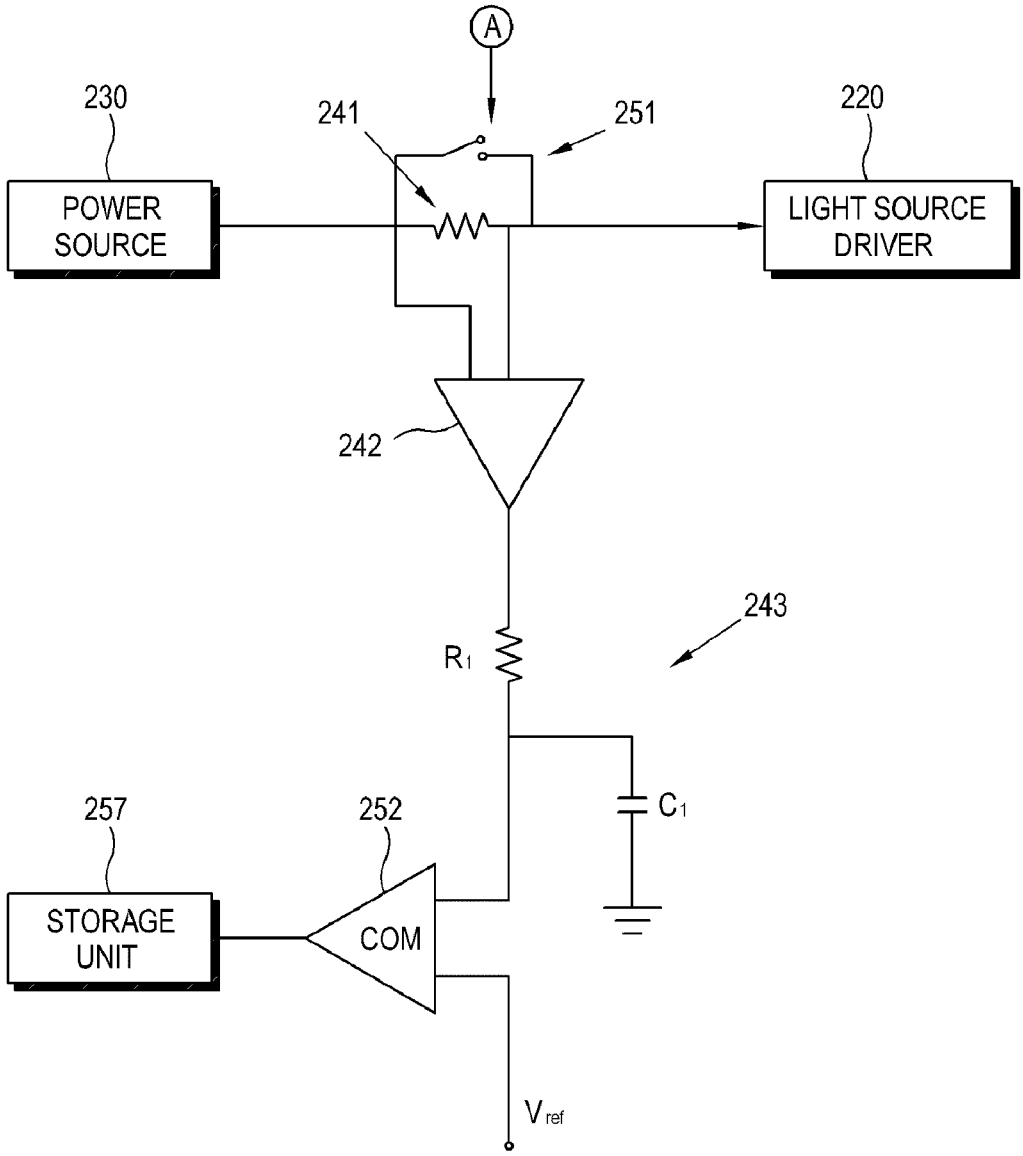
FIG. 2 is a schematic circuit diagram of a controller in FIG. 1.

Using constant voltage power, the power source 230 supplies a predetermined-level voltage to the light source driver 220. A current of the constant voltage power, which is output from the power source 230 to the light source driver 220, varies depending on efficiency of the light source driver 220, the number of the point light sources 210*a* of the light source 210 and errors of the point light sources 210*a*. Vi is a voltage of power output from the power source 230 to the light source driver 220, Ii is a current of power output from the power source 230 to the light source driver 220, Vo and Io are respectively a voltage and a current of power output from the light source driver 220 to the light source 210 and K is efficiency of the light source driver 220. Then, a formula is established as follows: $Vo*Io=Vi*Ii/\kappa$ The current detector 240 is provided between the power source 230 and the light source driver 220, and detects a current of power supplied from the power source 230 to the light source driver 220. As Vi is a constant as described above, Ii includes information on the light source 210. For example, if the point light sources 210*a* are open or short-circuit, Ii changes smaller or larger than the normal current. The current detector 240 detects the current and outputs it to the controller 250. The current detector 240 includes a resistor 241 and a current detection amplifier 242 as shown in FIG. 2. The current detection amplifier 242 amplifies a current detected from both ends of the resistor 241 to supply the current to a comparator 252 (to be described later). Preferably but not necessarily, the current detection amplifier 242 may include a differential amplifier. The current detector 240 further includes an RC filter 243 which is connected between the current detection amplifier 242 and the comparator 252 to reduce noises which may occur during the current detecting process. The RC filter 243 includes a resistor R1 which is connected with the current detection amplifier 242 in series, and a capacitor C1 which is connected with the resistor R1 and a ground terminal. The capacitor C1 may be connected with both ends of the comparator 252. Alternatively, the RC filter 243 may be provided between the resistor 241 and the current detection amplifier 242. The RC filter 243 may be replaced by various known filters to remove noises.

The controller 250 controls the light source driver 220 to sequentially drive the plurality of light source modules 211 to 215, and detects errors of the respective light source modules 211 to 215 by comparing the current detected sequentially by the current detector 240 with a preset acceptable range. The controller 250 sequentially drives the light source driver 220, but that does not mean to limit that it drives sequentially from the first driving module 221 to the fifth driving module 225. Instead, the controller 250 does not drive more than two driving modules 211 to 225 repetitively, but drives one by one in a predetermined sequence. If the controller 250 does not detect errors, it controls the light source driver 220 according to a dimming signal input from the outside.

FIG. 2 is a schematic circuit diagram of the controller 250 according to the present embodiment. As shown therein, the controller 250 includes a relay switch 251, the comparator 252 and a storage unit 257.

A related art display apparatus having a plurality of light source modules includes an error detecting circuit in end parts of respective driving modules or light source modules to detect errors of point light sources. As the size of the display panel increases, the number of the light source modules and driving modules increases, too. Also, the number of error detecting circuits increases, which enlarges the size and thickness of the backlight unit and raises production costs. The display apparatus according to the present embodiment does not have an error detecting circuit individually connected to the driving modules or to the light source modules, but sequentially drives the light sources modules 211 to 215 and detects a current between the power source 230 and the light source driver 220. If the current between the power source 230 and the light source driver 220 is out of the acceptable range, the controller 250 determines that the errors occur in the light source modules 211 to 215 driven when the current is detected. That is, the controller 250 may determine whether errors occur in the respective light source modules 211 to 215 according a simpler configuration than the related art configuration.

The controller 250 detects the errors only if a particular event occurs, thereby reducing power consumption due to the resistor 241. If the point light sources 210*a* supply light to the display panel 100 continuously while an image is displayed, a current applied from the power source 230 to the light source driver 220 has a much larger value than one of the light source modules 211 to 215 is driven. Thus, the controller 250 may detect errors at particular timing when a particular event occurs, e.g. when the display apparatus is power-on initially, when an image is not displayed on the display panel 100 in a standby mode or when power is not supplied to the display panel 100. Thus, power consumption is reduced, and the controller 250 may detect the errors while not affecting a user to view an image. The controller 250 applies a control signal ⓐ corresponding to the particular event to the relay switch 251. The relay switch 251 which is provided between the power source 230 and the light source driver 220 is turned on or off according to the control signal ⓐ. If the controller 250 detects the errors, the relay switch 251 is turned off so that power is output from the power source 230 to the light source driver 220 through the resistor 241. If an image is displayed normally, the relay switch 251 is turned on, and power output from the power source 230 to the light source driver 220 bypasses the resistor 241.

In some cases, the light source modules 211 to 215 are sequentially driven by the driving modules 221 to 225 at predetermined intervals. Then, the controller 250 may detect the errors when a particular event occurs as described above, or may detect the errors while supplying light normally to the display panel 100.

The comparator 252 compares a voltage corresponding to the detected current with a predetermined reference voltage, and outputs a control signal corresponding to the individual error information of the light source modules 211 to 215. If the light source modules 211 to 215 are in a normal state as the point light sources 210*a* are not open or short-circuit, the current flowing between the power source 230 and the light source driver 220 is $Ii=Vo*Io/Vi*\kappa$. If the point light sources 210*a* of the light source modules 211 to 215 are all open, a closed circuit is not formed to allow the current to flow. Thus, the current is not detected between the power source 230 and the light source driver 220. If a part of the point light sources 210*a* is open, a current larger than the normal current Ii may flow between the power source 230 and the light source driver 220. If the point light sources 210*a* are completely short-circuit, they act as a large capacity resistor, thereby flowing a current close to zero between the power source 230 and the light source driver 220. If the point light sources 210*a* are partly short-circuit, a current smaller than the normal current Ii flows therebetween.

The comparator 252 determines whether the voltage corresponding to the detected current is out of the preset acceptable range, based on the reference voltage. The reference voltage is set to be approximately 40% to 60%. For example, the reference voltage may be set to 50% of the voltage corresponding to the normal current Ii supplied to the power source 230 and the light source driver 220. The reference voltage is set as described above so that misjudgment on the noises is minimized when the errors are detected in consideration of the noises occurring during the current detecting process. If the voltage corresponding to the detected current is present between the reference voltage and a voltage corresponding to the normal current Ii, the light source modules 211 to 215 are in the normal state. If the voltage corresponding to the detected current exceeds the foregoing range or does not reach the range, it may be determined that the errors occur in the light source modules 211 to 215. The voltage comparison method of the comparator 252 may vary. For example, the reference voltage may be set corresponding to the normal current Ii or a plurality of reference voltages may be set to determine the extent of the errors.

The storage unit 257 stores information output by the comparator 252. The storage unit 257 stores information on the errors occurring in the light source modules, types of the errors and the particular light source modules 211 to 215 having the errors.

The controller 250 according to another exemplary embodiment may include an A/D (analog-to-digital) converter and a digital processor, instead of the comparator 252. That is, the configuration of the controller 250 is not limited to the foregoing configuration to detect the errors, and may include known hardware or software.

Figure 3:
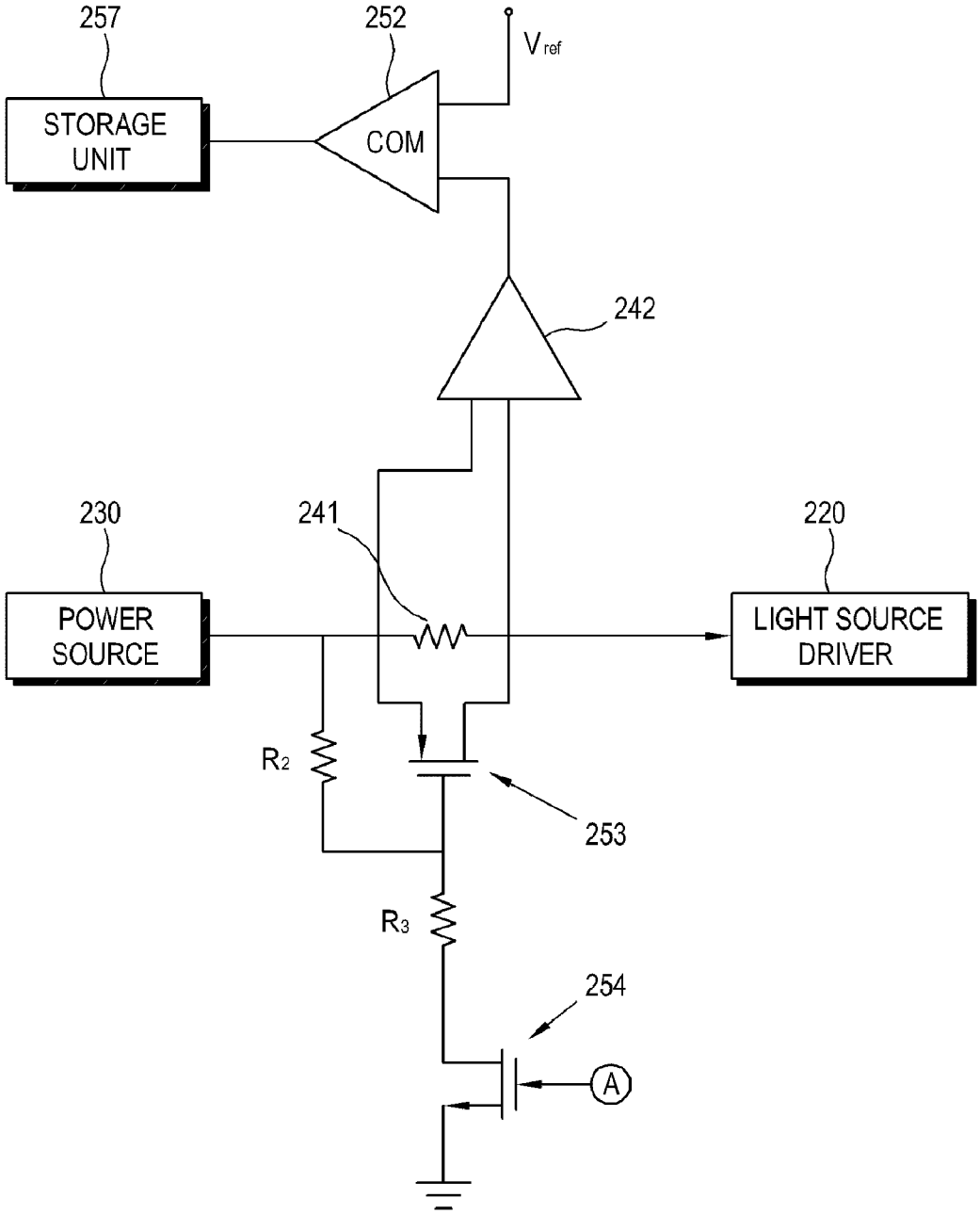
FIG. 3 is a schematic circuit diagram of a controller of a display apparatus according to a second exemplary embodiment of the present invention.

FIG. 3 is a schematic circuit diagram of a controller of a display apparatus according to a second exemplary embodiment of the present invention. As shown therein, the controller 250 includes a plurality of transistors 253 and 254 and resistors R2 and R3, instead of the relay switch 251. The first transistor 253 includes a P type transistor while the second transistor 254 includes an N type transistor differently structured from the first transistor 253. An input terminal of the second transistor 254 is connected with a control terminal of the first transistor 253. A pull-up resistor R2 is connected between the power source 230 and the control terminal of the first transistor 253 while a pull-down resistor R3 is connected between the control terminal of the first transistor 253 and the input terminal of the second transistor 254.

If a high signal is applied to the control terminal of the second transistor 254 to turn on the N type transistor, a low signal is applied to the control terminal of the first transistor 253 by the pull-down resistor R3. Then, the first transistor 253 is turned on, too, and power applied from the power source 230 to the light source driver 220 bypasses the resistor 241. Conversely, if a low signal is applied to the control terminal of the second transistor 254 to turn off the N type transistor, a high signal is applied to the control terminal of the first transistor 253 by the pull-up resistor R2. Then, the first transistor 253 is turned off, too, and power applied from the power source 230 to the light source driver 220 passes through the resistor 241. As a result, the high signal applied to the second transistor 254 corresponds to a control signal applied when normal power is supplied to the light source driver 230, and the low signal applied to the second transistor 254 corresponds to a control signal applied when the controller 250 detects errors.

The channel types of the first and second transistors 253 and 254 are not limited to the foregoing channels. If the channel types are changed with each other, the current flowing therebetween may be reverse according to the control signal.

Figure 4:
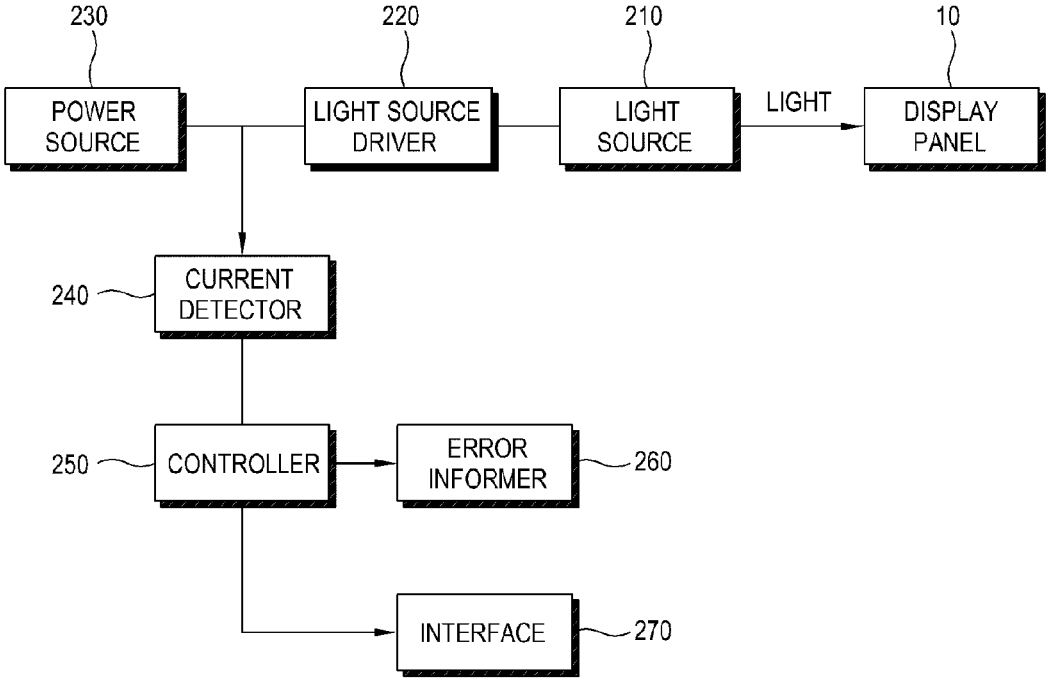
FIG. 4 is a control block diagram of a display apparatus according to a third exemplary embodiment of the present invention.

FIG. 4 is a control block diagram of a display apparatus according to a third exemplary embodiment of the present invention. As shown therein, the display apparatus according to the present embodiment further includes an error informer 260 and an interface 270.

If point light sources 210*a* are open or short-circuit to generate errors, the error informer 260 displays the error occurrence so that a user recognizes the errors of the light source 210. The error informer 260 may include a light emitting diode (LED) which flickers when the errors occur, or a sound output unit which outputs siren or particular sound when the errors occur. The error informer 260 may include a UI (user interface) generator to display UI information on the errors of the backlight unit, on the display panel 100. The UI information includes the error occurrence, the types of the errors and the light source modules 211 to 215 having the errors. The information on the light source modules 211 to 215 refer to information on a physical position of the light source modules 211 to 215 so that a user recognizes the specific light source module having the errors, among the plurality of light source modules 211 to 215.

If the errors occur in the light source modules 211 to 215, the interface 270 may transmit information of the error occurrence or the light source modules 211 to 215 having the errors. The information is stored in the storage unit 257, and may be transmitted to the outside through the interface 270 automatically or by user's selecting. The interface 270 may include a wired/wireless LAN unit for wired/wireless communication, a wireless communication unit such as Bluetooth, or a storage medium connector such as a memory card slot and a USB port. Through the interface 270, a use may inform the errors occurring in the backlight unit 200 to a service center, etc.

Figure 5:
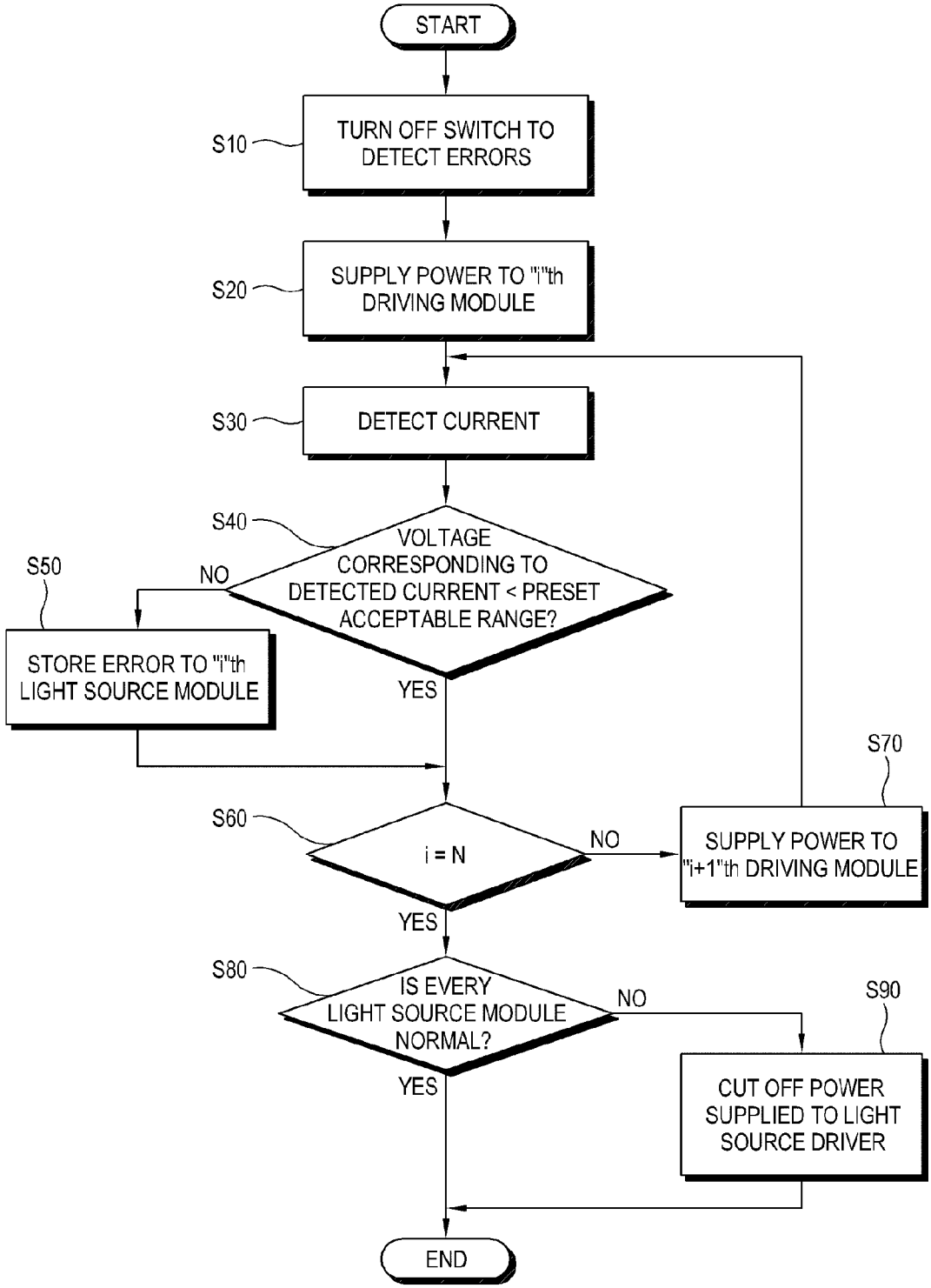
FIG. 5 is a control flowchart to describe a control method of the display apparatus according to an exemplary embodiment of the present invention.

FIG. 5 is a control flowchart to describe a control method of the display apparatus according to an exemplary embodiment of the present invention. The control method of the display apparatus will be described with reference to FIG. 5.

First, the controller 250 turns off the switch to detect the errors (S10). The switch may include the relay switch 251, and the transistors 253 and 254. If the switch is turned off, power is supplied through the resistor 241 connected between the power source 230 and the light source driver 220.

The controller 250 controls the light source driver 220 to sequentially drive the light source modules 211 to 215 and detects the errors, and power is sequentially supplied to the driving modules 221 to 225, starting from an "i" th driving module (S20).

The current detector 240 detects the current of power supplied to the "i" th driving module by the power source 230 (S30), and the controller 250 determines whether the voltage corresponding to the detected current is within the preset acceptable range (S40).

If the voltage corresponding to the detected current is not within the acceptable range, i.e., if an over current flows, a current lower than the reference voltage flows or if the current is not detected, the controller 250 determines that the errors occur in the "i" th light source module and stores the error occurrence in the storage unit 257 (S50). Then, the controller 250 determines whether the "i" corresponds to N, the number of the light source modules (S60).

If the voltage corresponding to the detected current is within the acceptable range, the controller 250 also determines whether "i" corresponds to N, the number of the light source modules (S60).

If "i" is not N, the controller 250 controls to supply power to a subsequent driving module, i.e., an "i+1" th driving module (S70) and repeats the operation after the current detection.

If "i" corresponds to N, the controller 250 determines whether all the light source modules 211 to 215 are in the normal state (S80). If errors are found even in a single light source module, power supplied to the light source driver 220 is cut off (S90). According to another control method, if errors are found in the predetermined number or more of the light source modules, instead of in a single light source module, power supplied to the light source driver 220 may be cut off.

If errors occur in the light source modules 211 to 215, the present invention may further include an operation of informing the error occurrence to a user and transmitting the error occurrence to the outside.

Figure 6:
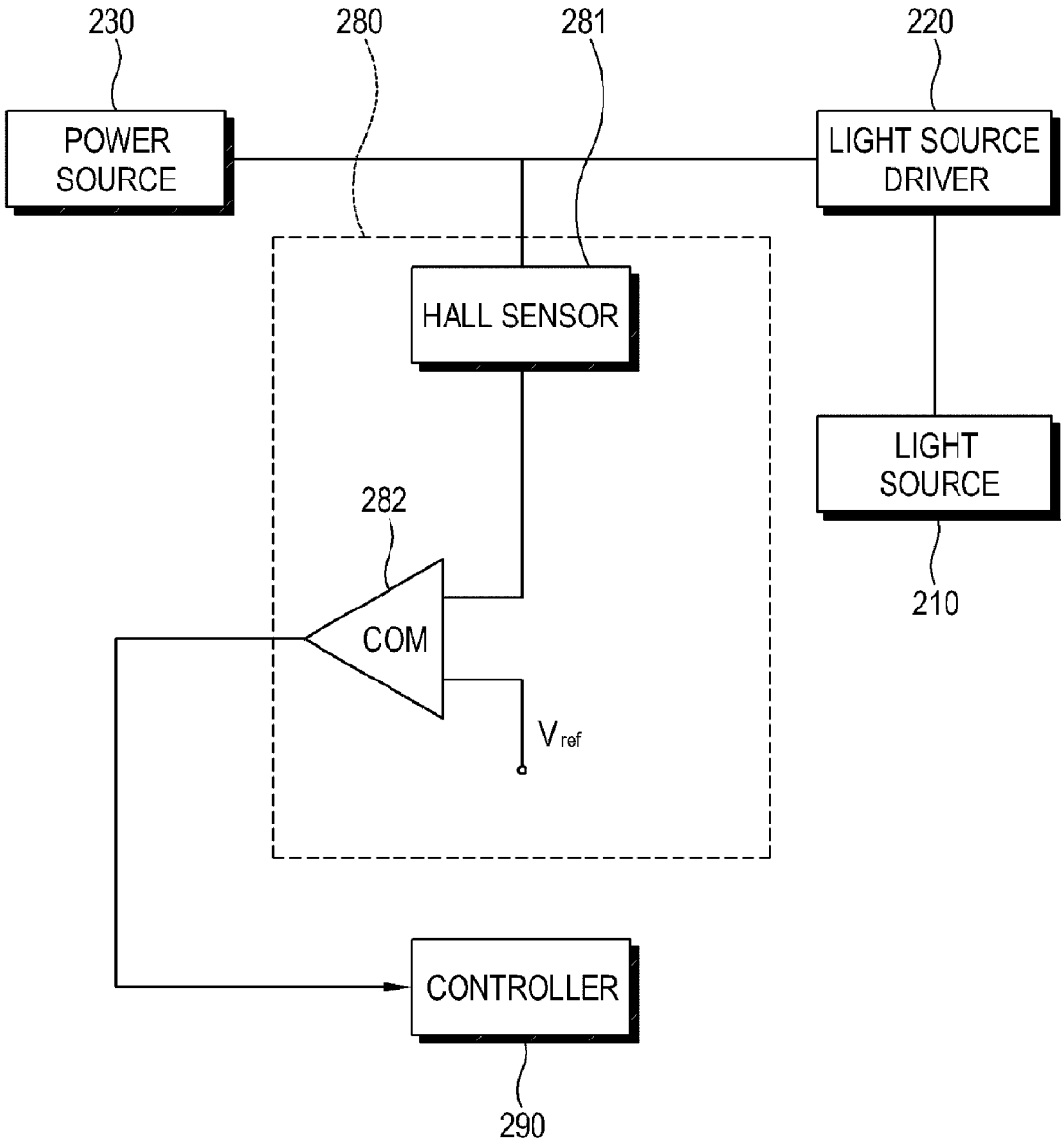
FIG. 6 is a control block diagram of a backlight unit of a display apparatus according to a fourth exemplary embodiment of the present invention.

FIG. 6 is a control block diagram of a backlight unit of a display apparatus according to a fourth exemplary embodiment of the present invention. As shown therein, the backlight unit includes a light source 210, a light source driver 220, a power source 230, an error detector 280 and a controller 290 which controls the foregoing elements. Description of the light source 210, the light source driver 220 and the power source 230 are omitted since it is repetitive.

The error detector 280 detects a current flowing between the power source 230 and the light source driver 220, and individually detects errors of the light source modules 211 to 215. The error detector 280 includes a hall sensor 281 corresponding to the current detector 240, and a comparator 282. If the error detector 280 includes the hall sensor 281, it does not include the resistor. Thus, the error detector 280 may accurately detect the current while not affecting the flow of the current. If the hall sensor 281 is used, the error detector 280 does not need to include switching elements 251, 253 and 254 to change the supply path of power. The error detector 280 may include a single chip, or a chip integrated with the controller 290.

If the error detector 280 detects the errors of the light source modules 211 to 215, the controller 290 stores error occurrence information, and the information on the types of the errors and the light source modules 211 to 215 having the errors in the storage unit 257, and cuts off power supplied to the light source driver 220 from the power source 230.

As described above, an exemplary embodiment of the present invention provides a backlight unit which detects errors of a light source without difficulty, a display apparatus comprising the same and a control method thereof.

Also, an exemplary embodiment of the present invention provides a backlight unit which informs errors of a light source to a user without difficulty, a display apparatus comprising the same and a control method thereof.

Further, an exemplary embodiment of the present invention provides a backlight unit which has a simple configuration and reduces production costs, a display apparatus comprising the same and a control method thereof.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display panel;

a light source which comprises a plurality of light source modules and supplies light to the display panel;

a light source driver which drives the plurality of light source modules;

a power source which supplies power to the light source driver;

a current detector which detects a current of the power supplied from the power source to the light source driver; and a controller which controls the light source driver to sequentially drive the plurality of light source modules and determines whether an error is detected in one of the source modules based on one of sequentially detected currents.

2. The display apparatus according to claim 1, wherein the controller comprises a comparator which compares a voltage corresponding to the one of the sequentially detected currents with a reference voltage.

3. The display apparatus according to claim 2, wherein the reference voltage is set to be approximately 40% to 60% of a voltage corresponding to a normal current supplied from the power source to the light source driver if the error is not detected in the one of the light source modules, and the controller detects the error in the one of the light source modules if the voltage corresponding to the one of the sequentially detected currents is lower than the reference voltage.

4. The display apparatus according to claim 1, wherein the current detector includes a resistor connected between the power source and the light source driver.

5. The display apparatus according to claim 4 further comprising a switch which is provided between the power source and the light source driver and which bypasses the resistor, wherein the controller turns off the switch so that the power supplied to the light source driver is supplied to the light source driver through the resistor if the error is detected.

6. The display apparatus according to claim 5, wherein the switch comprises a first type transistor connected with the resistor in parallel, and a second type transistor, which has an input terminal connected with a control terminal of the first type transistor, and which is differently structured from the first type transistor.

7. The display apparatus according to claim 1, wherein the current detector comprises a hall sensor.

8. The display apparatus according to claim 1 further comprising an interface which transmits at least one of information on error occurrence and information on the one of the light source modules having the error, if the error occur in the one of the light source modules.

9. The display apparatus according to claim 1 further comprising an error informer which displays an error occurrence if the error occurs in the one of the light source modules.

10. The display apparatus according to claim 1, wherein the controller cuts off the power supplied from the power source to the light source driver if the error occurs in the one of the light source modules.

11. The display apparatus according to claim 1, wherein the light source modules comprise a plurality of point light sources.

12. The display apparatus according to claim 1, wherein the light source driver comprises a plurality of driving modules which individually drives the light source modules.

13. A backlight unit comprising:

a light source which comprises a plurality of light source modules;

a light source driver which comprises a plurality of driving modules to drive one of the light source modules of the plurality of light source modules;

a power source which supplies power to the light source driver;

an error detector which detects a current of the power supplied from the power source to the light source driver, and compares the detected current with a range to detect whether there is an error in one of the respective light source modules; and a controller which controls the light source driver to sequentially drive the plurality of light source modules, and cuts off the power supplied from the power source to the light source driver if the error is detected in the one of the respective light source modules.

14. The backlight unit according to claim 13, wherein the error detector comprises a current detector which detects the current of the power supplied from the power source to the light source driver, and a comparator which compares a voltage corresponding to the detected current with a reference voltage.

15. The backlight unit according to claim 14, wherein the current detector includes a resistor connected between the power source and the light source driver.

16. The backlight unit according to claim 15 wherein the error detector further comprises a switch which is provided between the power source and the light source driver and which bypasses the resistor, and the controller turns off the switch so that power output from the power source is supplied to the light source driver through the resistor if the error detector detects whether the errors occur in the respective light source modules.

17. The backlight unit according to claim 14, wherein the current detector comprises a hall sensor.

18. The backlight unit according to claim 13 further comprising an error informer which displays an error occurrence if the error is detected in the one of the respective light source modules.

19. A control method of a display apparatus which has a display panel, a light source having a plurality of light source modules, a light source driver driving the light source modules and a power source supplying power to the light source driver, the control method comprising:

sequentially driving the plurality of light source modules;

sequentially detecting currents of the power supplied from the power source to the light source driver; and determining if an error is detected in one of the plurality of light source modules by comparing one of the detected currents with a range.

20. The control method according to claim 19 further comprising cutting off the power supplied from the power source to the light source driver if the error is detected in the one of the plurality of light source modules.

21. The control method according to claim 19 further comprising informing of an error occurrence if the error occurs in the one of the plurality of light source modules.

* * * * *